US006201347B1

(12) United States Patent
Smulders

(10) Patent No.: US 6,201,347 B1
(45) Date of Patent: Mar. 13, 2001

(54) LOW-PRESSURE DISCHARGE LAMP

(75) Inventor: Marcellus H. Smulders, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/160,493

(22) Filed: Sep. 25, 1998

(30) Foreign Application Priority Data

Oct. 9, 1997 (EP) ..... 97203145

(51) Int. Cl.[7] ..... H01J 17/22
(52) U.S. Cl. ..... 313/547; 313/550
(58) Field of Search ..... 313/547, 490, 313/550, 161; 315/248

(56) References Cited

U.S. PATENT DOCUMENTS 4,924,145 * 5/1990 Buschmann ..... 313/490
5,841,229 * 11/1998 Borowiec et al. ..... 313/490
5,912,536 * 6/1999 Michiels et al. ..... 313/493

FOREIGN PATENT DOCUMENTS 2511417 11/1976 (DE) ..... H01J/61/28
2306765 7/1997 (GB) ..... H01J/65/04
2306765A 7/1997 (GB) ..... H01J/66/04

OTHER PUBLICATIONS

Patent Abstract of Japan 60–10551 A, Toshiba, Jan. 1985, Claims 1–6, Manufacture of Low Pressure Mercury Vapor Discharge Lamp.
Patent Abstract of Japan: 610551; Publication Date.

* cited by examiner

*Primary Examiner*—Nimeshkumar D. Patel
*Assistant Examiner*—Todd Reed Hopper
(74) *Attorney, Agent, or Firm*—F. Brice Faller

(57) ABSTRACT

The lamp is provided with a metal holder (21) having an opening (21*a*) and resilient body (20) which fastens the holder in a tube (15) which is in communication with the discharge space. A first portion (20*a*) of the resilient body (20) is clamped in the opening (21*a*) of the holder (21). A second folded portion (21*b*) is clamped in inside the tube (15).

6 Claims, 2 Drawing Sheets

LOW-PRESSURE DISCHARGE LAMP

BACKGROUND OF THE INVENTION

The invention relates to a low-pressure discharge lamp provided with a light-transmitting discharge vessel which encloses a discharge space in a gastight manner and which contains an ionizable filling comprising an evaporable component, and further provided with a holder having an opening and with a resilient body which fastens the holder in a tube which is in communication with the discharge space, which low-pressure discharge lamp is further provided with means for maintaining a discharge in the discharge space.

Such a low-pressure discharge lamp, containing mercury as the evaporable component, is known from DE 25 11 417 AS. The holder is designed here for dispensing the mercury during lamp manufacture. The tube in which the holder is accommodated serves as an exhaust tube through which the discharge vessel is evacuated and filled during lamp manufacture. The resilient body is fused at one end in an end portion of the discharge vessel and at its opposite end clamps the holder against the wall of the exhaust tube. To counteract a loss of mercury, the holder is not opened until after evacuation and filling of the discharge vessel and after closing of the exhaust tube by fusion, for example in that the holder is heated through high-frequency induction. It is a disadvantage that the holder requires many operations in the manufacture of the known lamp, such as closing of the holder, fastening of the resilient body in the tube, positioning of the holder, and opening of the holder.

SUMMARY OF THE INVENTION

It is an object of the invention to provide a low-pressure discharge lamp of the kind mentioned in the opening paragraph which is simpler to manufacture. The lowpressure discharge lamp according to the invention is for this purpose characterized in that the resilient body has a first portion which is clamped in the opening of the metal holder, and a second, folded portion which is clamped in the tube. In the manufacture of the lamp according to the invention, the first portion of the resilient body is provided in the opening of the holder and the holder is subsequently pinched together in that location, after a material such as mercury, an amalgam, an amalgam-forming metal, or an amalgam-forming alloy has been provided in the holder. The holder is fastened to the resilient body thereby and the opening in the holder is reduced at the same time. Then the holder can be passed into the tube. The second, folded portion of the resilient body keeps the holder fastened in the tube then. It was found that on the one hand mercury vapor is capable of passing through the resulting opening in a sufficient quantity for rendering possible lamp operation. On the other hand, the resulting opening of the holder is sufficiently small for preventing a loss of material in liquid or solid form from the holder. If so desired, the tube which is in communication with the discharge space may be cooled during manufacture until it is closed so as to counteract also the evaporation of any material from the holder.

The resilient body is constructed, for example, as a metal tape. In a practical embodiment, the resilient body is a wire, for example having a thickness of a few tenths of a millimetre up to approximately one millimetre. The resilient body can then be readily fastened to the holder.

The holder of the lamp according to the invention may be subject to comparatively strong mechanical loads during manufacture. It may happen then that the wire works itself loose from the opening of the holder under the influence of vibrations. In a favorable embodiment, the first portion of the wire has a thickened end. This counteracts a detachment of the wire caused by vibrations.

In a yet more favorable embodiment, the first portion of the wire is bent into a U-shape. This measure, too, contributes to the fastening of the first end portion of the wire in the holder. In addition, the dimensions of the remaining opening of the holder may then be readily chosen through a choice of the thickness of the wire and the width of the U-shape, i.e. the distance between the centre lines of the legs of the U-shape.

If mercury is used as the evaporable component in the ionizable filling, the holder and the resilient body may be manufactured from metals which do not form amalgams and which are usual for low-pressure mercury discharge lamps, such as niobium, tantalum, iron, nickel, chromium, or alloys thereof.

In an attractive embodiment, the resilient body supports an auxiliary amalgam. A separate fastening of the auxiliary amalgam is not necessary then. The auxiliary amalgam may be directly applied to the resilient body, but alternatively it may be provided on a carrier, for example made of gauze.

It is favorable for a good operation of the auxiliary amalgam if the resilient body extends into the discharge space.

It is self-evident that the nature of the means for maintaining the discharge is immaterial to the invention. Said means may be constructed, for example, as a pair of electrodes, which may or may not be positioned in the discharge vessel. Alternatively, the means may be constructed as a coil by means of which an alternating magnetic field is generated in the discharge space during operation. Preferably, the coil is positioned outside the discharge space because electrical lead-throughs into the discharge vessel are thus avoided.

DESCRIPTION OF THE PREFERRED EMBODIMENT

Figure 1:
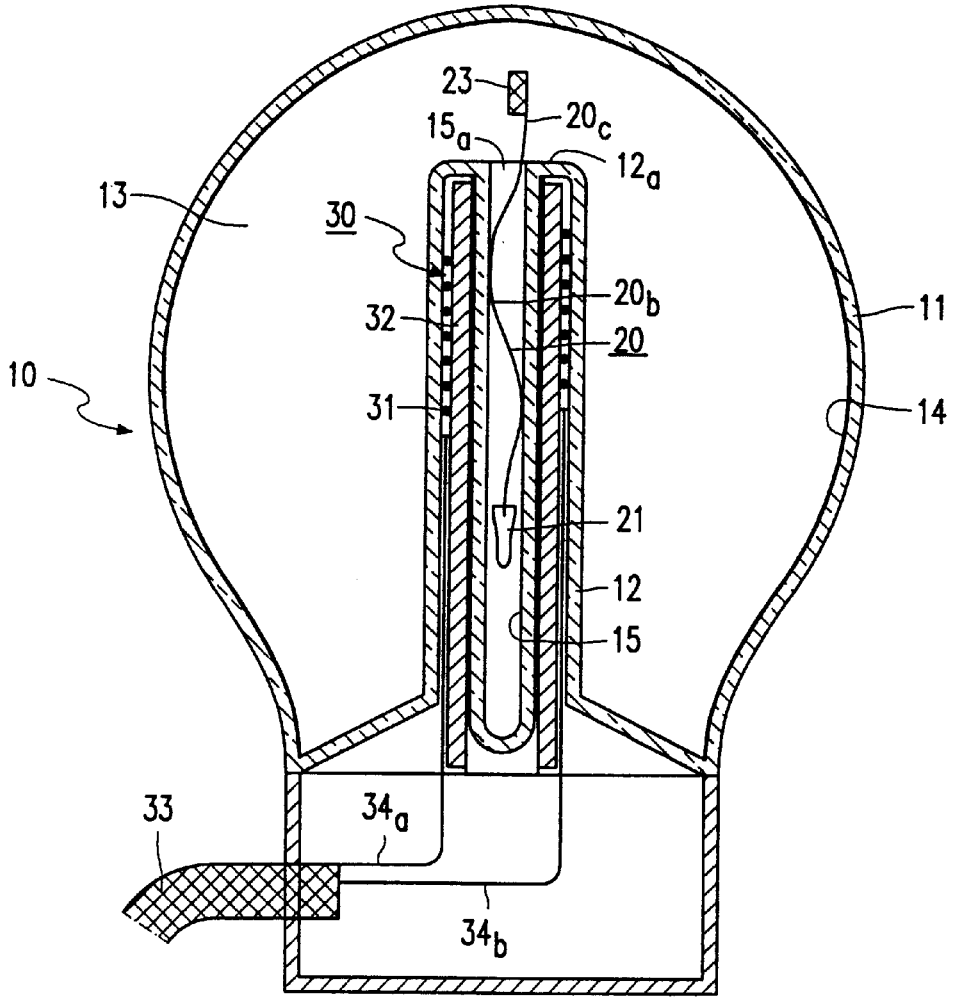
FIG. 1 shows an embodiment of the low-pressure discharge lamp according to the invention.

FIG. 1 shows a low-pressure discharge lamp provided with a light transmitting discharge vessel 10 with an enveloping portion 11 and a recessed portion 12. The discharge vessel 10 encloses a discharge space 13 in a gastight manner, having an ionizable filling comprising an evaporable component, mercury in this case, here in combination with the rare gases neon and argon. In the embodiment shown, the discharge vessel has a luminescent layer 14 at an internal surface. The recessed portion 12 has an end 12*a* facing towards the discharge space 13 where a tube 15 with an internal diameter of 4.6 mm issues into the discharge space 13. The tube 15 is in communication with the discharge space 13 via its mouth 15*a*. The tube 15 served as an exhaust tube during lamp manufacture. A holder 21 is fastened in the tube 15 by means of a resilient body 20. Means 30 for maintaining a discharge in the discharge space 13 are formed by a coil 31 provided in the recessed portion 12. The coil surrounds a core 32 of soft magnetic material around the tube 15. The coil 31 is connected to a supply unit (not shown) via a cable 33 with conductors 34*a*, 34*b*.

Figure 2:
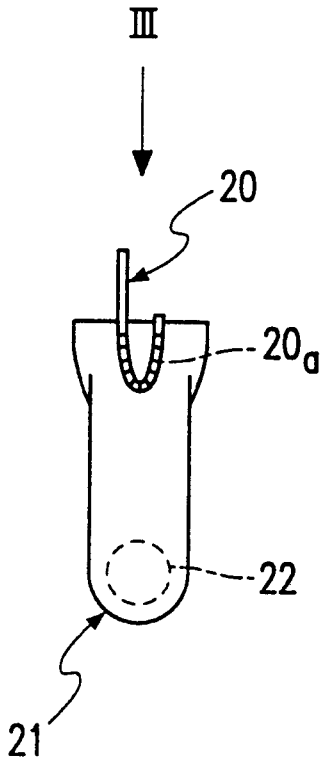
FIG. 2 shows the holder in more detail, the first portion of the resilient body being indicated with stripes.
Figure 3:
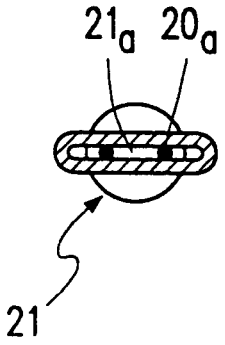
FIG. 3 is an elevation of the holder viewed along III in FIG. 2.

FIGS. 2 and 3 show in more detail how a first portion 20*a* (shown striped) of t he resilient body 20 is pinched tightly in the opening 21 a of the metal holder 21. A second, folded portion 20*b* is clamped in the tube 15. The holder 21 is here constructed as a niobium cup. The length, external diameter, and wall thickness of the holder are 15 mm, 3 mm, and 0.7 mm, respectively. The resilient body is constructed as a wire of a nickel-iron alloy with a thickness of 0.7 mm. The first portion 20*a* of the wire 20 which is clamped in the opening of the holder 21 has a U-shape, which U-shape has a width of 2 mm. The second portion 20*b* is bent into an S-shape. An amalgam 22, BilnHg here, accommodated in the holder 21 is shown with a broken line. The resilient body 20 extends into the discharge space 13 and supports an auxiliary amalgam 23, 4 mg PbSn provided on a nickel-iron gauze in this case, at its end 20*c* remote from the holder 21. In an alternative embodiment, the resilient body itself serves as the support for the auxiliary amalgam. In that embodiment, the resilient body is coated, for example, with indium, for example with a coating weight of 0.04 to 0.25 mg/cm.

What is claimed is:

1. A low-pressure discharge lamp comprising a light-transmitting discharge vessel which encloses a discharge space in a gastight manner and which contains an ionizable filling comprising an evaporable component, a container for dispensing having an opening a resilient body which fastens said container for dispensing in an exhaust tube which is in communication with the discharge space, and means for maintaining a discharge in the discharge space, wherein the resilient body has a first portion which is clamped in the opening of the container for dispensing and a second, folded portion which is accommodated in the exhaust tube with clamping fit.

2. A low-pressure discharge lamp as claimed in claim 1, characterized in that the resilient body (20) is a wire.

3. A low-pressure discharge lamp as claimed in claim 2, characterized in that the first portion (20*a*) of the wire (20) has a thickened end.

4. A low-pressure discharge lamp as claimed in claim 2, characterized in that the first portion (20*a*) of the wire (20) is bent into a U-shape.

5. A low-pressure discharge lamp as claimed in claim 1, characterized in that the resilient body (20) supports an auxiliary amalgam (23).

6. A low-pressure discharge lamp as claimed in claim 5, characterized in that the resilient body (20) extends into the discharge space (13).

* * * * *